United States Patent [19]

Kamiyama et al.

[11] Patent Number: 4,737,941

[45] Date of Patent: Apr. 12, 1988

[54] WATCH WITH HAND IN FORM OF CIRCULAR FILM AND PROVIDED WITH ELECTROSTATIC SHIELDING DEVICE

[75] Inventors: Yasuo Kamiyama, Sayama; Masao Mafune, Kawagoe, both of Japan

[73] Assignee: Citizen Watch Co., Ltd., Tokyo, Japan

[21] Appl. No.: 41,333

[22] Filed: Apr. 22, 1987

[30] Foreign Application Priority Data

| | | | |
|---|---|---|---|
| May 9, 1986 | [JP] | Japan | 61-69581[U] |
| May 9, 1986 | [JP] | Japan | 61-69587[U] |
| Jul. 8, 1986 | [JP] | Japan | 61-158853 |
| Aug. 26, 1986 | [JP] | Japan | 61-129668[U] |

[51] Int. Cl.[4] ..... G04B 19/20

[52] U.S. Cl. ..... 368/77; 368/221; 368/233

[58] Field of Search ..... 368/233, 234, 221, 77

[56] References Cited

U.S. PATENT DOCUMENTS 4,362,397 12/1982 Klingenberg .
4,407,586 10/1983 Musy .
4,459,032 7/1984 Musy .

FOREIGN PATENT DOCUMENTS 56-673 1/1981 Japan .
56-27678 3/1981 Japan .
56-61675 5/1981 Japan .
57-34480 2/1982 Japan .
57-6550 2/1982 Japan .
2056126 3/1981 United Kingdom .

*Primary Examiner*—Bernard Roskoski
*Attorney, Agent, or Firm*—Finnegan, Henderson, Farabow, Garrett & Dunner

[57] ABSTRACT

A wrist watch with hour and minute hands in the form of rotatable circular films, having an electrostatic shielding device which grounds a glass of the watch through a back cover of the watch, to eliminate static electricity produced in the glass. Also, because of the use of thin rotatable circular films for the minute and hour hands, the thickness of the watch can be considerably reduced.

22 Claims, 11 Drawing Sheets

WATCH WITH HAND IN FORM OF CIRCULAR FILM AND PROVIDED WITH ELECTROSTATIC SHIELDING DEVICE

BACKGROUND OF THE INVENTION

1. Field of the Invention

The present invention relates to a wrist watch with hour and minute hands, i.e., analog-type watch, wherein at least one of the hands is in the form of a rotatable circular film.

The present invention also relates to an electrostatic shielding device in the analog-type watch.

2. Description of the Related Art

There has always been a demand for "slim", i.e., thin, wrist watches, particularly in the field of analog-type wrist watches (hereinafter, watch). The thinning of the thickness of a wrist watch can be realized by reducing the thickness of the movement of the watch and the distance between the outer glass and the dial. Many solutions to the problem of a reduction of the thickness of the movement have been proposed, but the distance, i.e., space, between the glass and the dial in which the hour hand and the minute hand are arranged is not easily decreased, since the hour hand and the minute hand must be spaced from each other an from the glass and the dial. Namely, if the hands come into contact with each other or with the dial or the glass during rotation of the hands, the hands may jam and become immovable, and eventually, the watch will stop. In particular, when the two hands collide, the rotation of the hands may come to a complete stop. Accordingly, the inevitable gaps between the minute hand and the hour hand, between the hands and the glass, and between the hands and the dial are an obstacle to a reduction of the total thickness of the watch.

Under these circumstances, it has been proposed to replace the conventional hands, which are, for example, in the form of needles or the like, with rotable circular films which have minute and hour hands depicted thereon, respectively. Wrist watches having minute and hour hands which are in the form of circular films are disclosed, for example, in Japanese Unexamined Patent Publication (Kokai) Nos. 56-673, 56-61675, 57-34480, and 56-27678.

The circular films and the case of the watch are usually made of a plastic material or the like, and the glass of the watch is usually made of glass material, but sometimes is also made of a plastic material.

In this kind of watch, which has hour and minute hands in the form of circular films, the problem of the production of static electricity has been newly raised. Namely, if the glass of the watch is subjected to friction by the clothes or hands of the wearer of the watch, static electricity accumulates in the glass.

In particular, static electricity is easily produced in relatively dry and cold weather. Due to this static electricity, the plastic circular film carrying the hour hand or the plastic circular film carrying the minute hand, or both, is (are) attracted by the electrostatic glass. As a result, the static electricity in the glass is directly transmitted to the circular films by contact between the circular films and the glass, or static electricity also accumulates in the circular films due to electrostatic induction. Consequently, the circular films are attracted to each other or are attracted by the glass or the dial, with the result that a motor which drives the circular films for rotation is subjected to an increasing load. This results in an increased consumption of electric power needed to drive the motor, and to a retardation of the rotation of the circular film(s) or a complete failure of the operation of the watch.

In addition to the foregoing, the circular films can become stuck together or to the glass or the dial due to a layer of water vapor therebetween, which can permeate into the watch if the watch is not completely waterproof.

The prior arts mentioned above do not teach any solution to the problem of static electricity. Also, the watches of the prior arts mentioned above have a complex construction, since the circular films are rotated by a movement which is separate from the circular films and which engages the outer peripheries of the circular films to cause rotation thereof.

SUMMARY OF THE INVENTION

The primary object of the present invention is, therefore, to provide a slim watch having hour and minute hands, at least one of which hands is in the form of a circular film, and in which the problem of the static electricity is solved.

Another object of the present invention is to provide a slim and simple watch having hour and minute hands, at least one of which hands is in the form of a circular film, and which has a simple movement for rotating the circular film or films.

To achieve the objects mentioned above, according to the present invention, there is provided a watch having hour and minute hands, at least one of which hands is in the form of a rotatable circular film, comprising a case, a movement which includes a drive for rotating the hour and minute hands, a train wheel which transmits the rotation of the drive to the hour and minute hands, a minute pinion operatively connected to the train wheel to rotate the minute hand, an hour wheel operatively connected to the minute pinion to rotate the hour hand, and a glass which is attached to the case to cover the movement on one side of the case, and a back cover which is attached to the case to cover the movement on the opposite side of the case and which is made of an electrically conductive material, wherein the improvement comprises an electrostatic shielding mean by which static electricity produced in the glass is conducted to the back cover of the watch case and released therefrom by grounding through the wearer of the watch.

Namely, the glass can be grounded by conducting the static electricity produced in the glass to the back cover of the watch, and then to the wearer's wrist. Thus, the watch of the present invention avoids the problems mentioned above.

BRIEF DESCRIPTION OF THE DRAWINGS

The invention will be described below in detail with reference to the accompanying drawings, in which.

DESCRIPTION OF THE PREFERRED EMBODIMENTS

Figure 1:
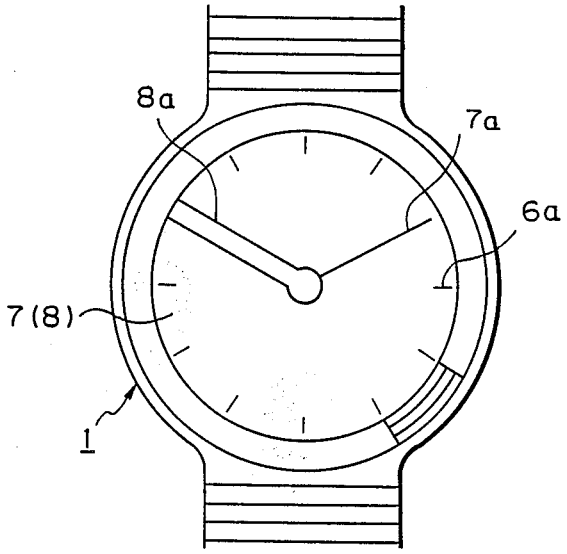
FIG. 1 is a plan view of a watch according to the present invention.

In FIG. 1 which shows a watch 1 of the present invention, the hours are indicated by an hour hand 8*a* which is depicted on a circular film 8 and the minutes are indicated by a minute hand 7*a* which is depicted on a circular film 7. In FIG. 1, twelve time graduations 6*a* are depicted on a dial 6 (FIG. 3), and in the Figure, the hour hand 8*a* is at the graduation 6*a* denoting the ten position and the minute hand 7*a* is at the graduation 6*a* denoting the 2 position; i.e., the watch indicates a time of 10:10.

Figure 2:
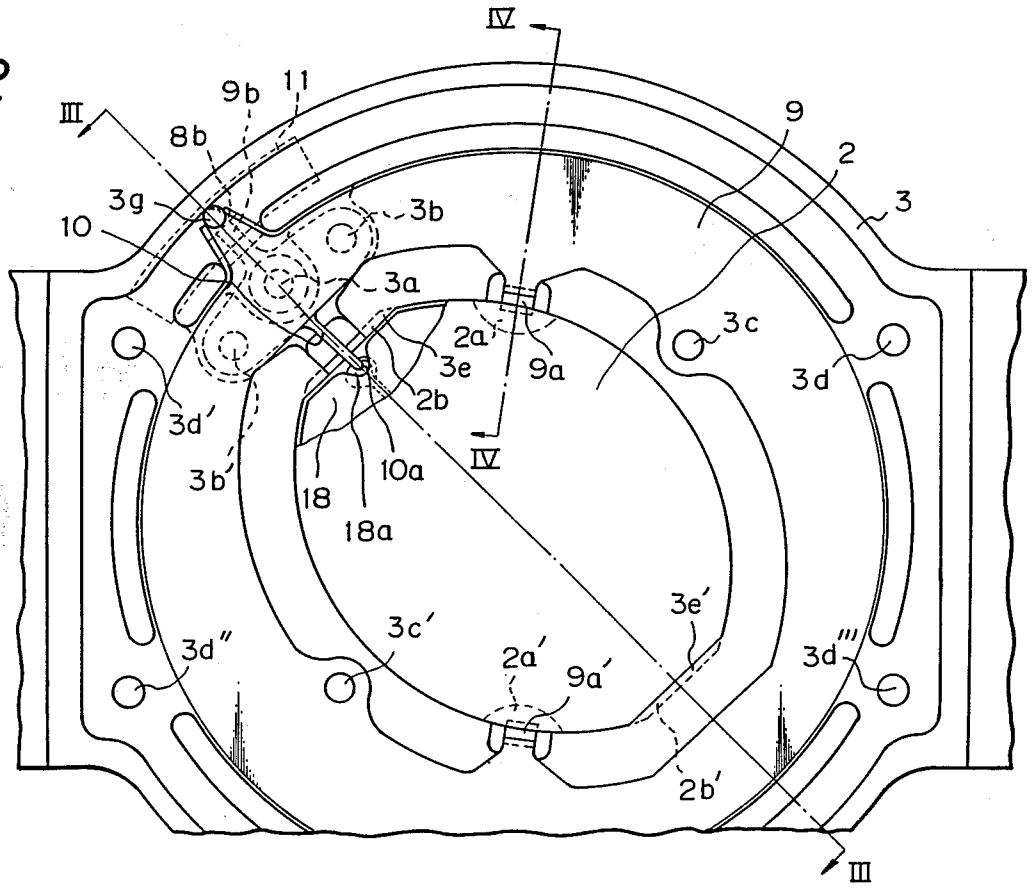
FIG. 2 is an enlarged bottom view of a watch of FIG. 1 with the circular films carrying the hour and minute hands and the dial removed.
Figure 3:
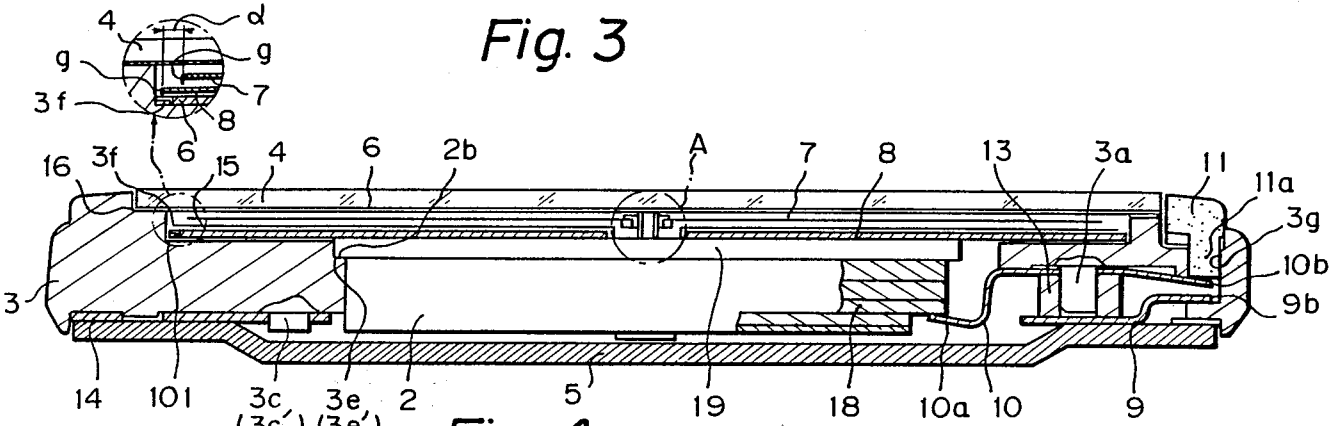
FIG. 3 is a sectional view taken along the line III—III in FIG. 2.

In FIGS. 2 and 3, the movement of the watch 1 is mounted on a main plate 19, on which watch elements such as a coil terminal sheet 18, etc., are superimposed.

An electrically conductive switch lever 10 is secured in place by bosses 3*a*, 3*b*, and 3*b*′ provided on a case 3 of the watch 1, and is provided with a spring contact 10*a* at one thereof, which comes into contact with a conductive pattern 18*a* of the coil terminal sheet 18, and a spring contact 10*b*, which is opposed to a push button switch 11, is provided on the other end of the switch lever 10.

An electrically conductive ground spring 9, which functions as an electrostatic shielding member and as a support of the movement 2, is held between the case 3 and a back cover 5 secured to the case 3 through a sealing packing 14, through an insulative switch spring seat 13 fitted onto the boss 3*a*. The ground spring 9 has an electrical contact portion 9*b* located directly below the spring contact 10*b* of the switch lever 10. The spring 9 is annular and rs provided with movement supporting portions 9*a* and 9*a*′ which are, for example, substantially diametrically opposed to each other and which are bent upward to form upright walls. The free ends of the movement supporting portions 9*a* and 9*a*′ laterally bent toward the dial 6 to form ground contacts which come into electrical contact with corresponding thinner portions 2*a* and 2*a*′ of the main plate 19, which is usually made of a metal. The push button switch 11 is secured to the case 3 by an adhesive 17, as can be seen from FIG. 5. The push button switch 11 will be described in detail hereinafter.

The movement 2 is secured to the case 3 by the ground spring 9, and the dial 6 is secured to the case 3 by an adhesive double coated tape 15. On the dial 6 are provided a circular film 7 carrying a minute hand 7*a* and a circular film 8 carrying an hour hand 8*a* (FIG. 1), and these films 7 and 8 are operatively connected to the movement 2. The minute hand film 7 is provided with a protective glass 4 which is usually made of a glass material or a plastic material or the like and which is secured to the case 3 by an adhesive double coated tape 16 or the like.

The elements mentioned above are assembled as follows. First, the switch lever 10 is incorporated in the case 3 in such a manner that the bosses 3*a*, 3*b*, and 3*b*′ of the case 3 are inserted in corresponding holes of the switch lever 10. Then the cylindrical switch spring seat 13, which is made of an electrically insulative material such as plastic, is fitted onto the boss 3*a* and the ground spring 9, which is also adapted to support the movement 2, is then fitted onto bosses 3*c* and 3*c*′ provided on the case 3, by fitting the bosses 3*c* and 3*c*′ into corresponding holes in the ground spring 9.

The sealing packing 14 for the back cover 5 is then placed on the case 3 and the electrically conductive back cover 5 is secured to the case 3 by, for example, four self-tapping screws 12, which are screwed in four corresponding holes 3*d*, 3*d*′, 3*d*″, and 3*d*‴ formed in the case 3. The ground spring 9 is held between the case 3 and the back cover 5.

The movement 2 is inserted in the case 3 from above in FIG. 3, so that stepped portions 2*b* and 2*b*′ of the main plate 19 are located on corresponding stepped receiving surface portions 3*e* and 3*e*′ of the case 3. At the same time, the movement supportrng portions 9*a* and 9*a*′ of the ground spring 9 come into elastic engagement with the corresponding thinner portions 2*a* and 2*a*′ of the main plate 19 holding the movement 2, so that the main plate 19, and accordingly, the movement 2, are held by the ground spring 9 substantially without the possibility of an accidental displacement of the movement 2 in either the vertical or the rotational direction.

The dial 6 is directly secured to the case 3 by an adhesive double coated tape 15. The dial 6 has a recess 101 (FIG. 3) into which a positioning projection 3*f* provided on the case 3 is fitted, so that the dial 6 is correctly set in place on the case 3.

The hour hand film 8 and the minute hand film 7 are then assembled on the movement 2, and finally, the glass 4 is directly secured to the case 3 by an adhesive double coated coated tape 16, to complete the assembly.

Note, obviously either the film 7 or 8 can be replaced with a conventional needle shaped minute or hour hand, as will be described hereinafter.

Figure 5:
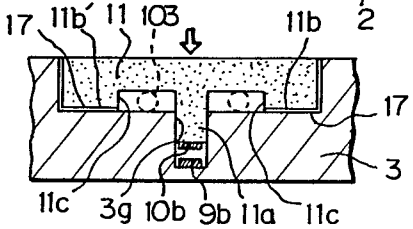
FIG. 5 is an enlarged sectional view of a switch portion of the watch shown in FIG. 1.

With reference to FIG. 5, the push button switch 11 has a cylindrical shaft portion 11*a* and a recess 11*c* surrounding the shaft portion 11*a*. The shaft portion 11*a* is slidably fitted in a corresponding circular hole 3*g* formed in the case 3, and opposite ends 11*b* and 11*b'* of the switch 11 are secured to the case 3 by an adhesive 17. The recess 11*c* allows an elastic deformation of the switch 11 whereby the shaft portion 11*a* thereof is moved up and down in the hole 3*g*. Namely, when the switch 11 is pushed down, the shaft portion 11*a* of the switch 11 is moved down in the hole 3*g* to establish an electrical connection between the spring contact 10*b* of the switch lever 10 and the ground contact 9*b* of the ground spring 9.

The switch 11 is restored to the initial position, by the elasticity thereof, when the external force applied to the switch 11 is released.

The switch lever 10 is elastically and electrically connected at the spring contact end 18*a* thereof to a time correcting signal input pattern 18*a* formed on the coil terminal sheet 18 of the movement 2. The spring contact 10*b* at the opposite end of the switch lever 10 is extended below the shaft portion 11*a* of the push button switch 11, so that when the push button switch 11 is pushed down, in the direction designated by an arrow in FIG. 5, the spring contact 10*b* is moved down to be electrically connected to the ground contact 9*b* of the ground spring 9. The elasticity of the spring contact 10*b* of the switch lever 10 also contributes to the restoration of the push button switch 11, which is usually made of rubber or the like, to the initial position thereof because the spring contact 10*b* of the switch lever 10 is in constant contact with the bottom of the shaft portion 11*a* of the switch 11.

The ground contact 9*b* of the ground spring 9 is located below the spring contact 10*b* of the switch lever 10, as mentioned before, so that when the spring contact 10 is elastically deformed, and thus brought into contact with the ground contact 9*b*, the time correcting signal is input to a control circuit (not shown) in the movement 2. This control circuit is disclosed, for example, in Japanese Examined Patent Publication (Kokoku) No. 57-6550. Since the present invention is not directed to the time correction effected by the operation of the push button switch 11, which operation is per se known, a detailed explanation therefore is not given herein.

In this embodiment of the invention, the total thickness of the case 3 is about 3.5 mm, which is very thin in comparison with that of a conventional wrist watch having a crown for correcting the time, since in the conventional type of watch, a lateral hole (which usually has a diameter of about 1 mm) must be provided on the side of the case 3 for the crown, and this limits reduction of the total thickness of the case 3. The push button switch 11 of this embodiment does not increase the total thickness of the case 3, since the hole for a crown becomes unnecessary, which contributes to the realization of a thinner watch. The hole for the crown also has another disadvantage of an increase in the possibility of a cracking of the case 3. This possibility is decreased in the present invention.

In addition, because the push button switch 11 is actuated from above and not from the side of the case 3 in the present invention, the case 3, which is usually made of plastic, can be molded by only two split molding dies, i.e., upper and lower molding dies. On the contrary, if the case has a hole for the crown as in the conventional type of watch, at least three molding dies which are split in three directions become necessary. Namely, according to the present invention, an auxiliary effect of a simplification of the molding process for molding the case can be expected.

Figure 4:
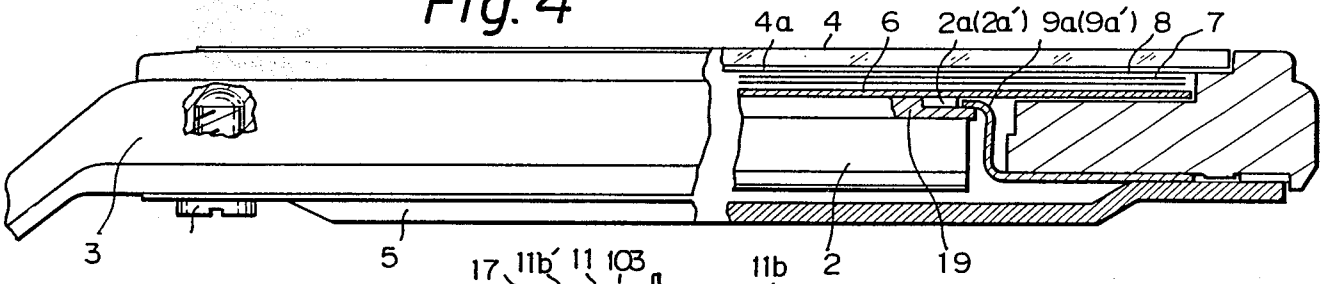
FIG. 4 is a sectional view taken along the line IV—IV in FIG. 2.

It should be also appreciated that the holes 3*d*–3*d'''* (FIG. 2) for the self-tapping screws 12 are provided on the bezel portion (outside of the glass 4) of the case 3, which portion is relatively thick, even taking the decreased thickness of the case of the watch according to the present invention into consideration. Preferably, the holes 3*d*–3*d'''* are rounded at the bottoms thereof to be semispherical, as shown in FIG. 4, to prevent a concentration of stress at the bottoms thereof and to increase an effective thread length of the self-tapping screws 12 in the corresponding holes 3*d*–3*d'''*.

Preferably, a sealing member 103, such as an O-ring is provided in the recess 11*c* of the push button switch 11 to enhance the sealing effect against water vapor.

Since the movement 2 is firmly held by the movement supporting portions 9*a* and 9*a'* of the ground spring 9, it is not necessary to use the dial 6 to support the movement 2, and accordingly, the dial 6 can be secured to the case 3 only by the adhesive double coated tape 15, which is strong enough to support the dead weight of the dial 6. Accordingly, because the dial 6 is not attached to the movement 2, the thickness of the dial 6 can be reduced. Note, it has been confirmed that the thickness of the dial 6 can be reduced to a half of the thickness of the dial of the conventional watch, in which the dial must be provided with legs to which the movement is attached. Also, the glass 4 can be secured to the case 3 only by the adhesive double coated tape 16 which is strong enough to support the glass 4, similar to the dial 6, and thus the glass 4 is not attached to either the movement 2 or the dial 6. This contributes to a reduction in the thickness and weight of the glass 4, and to a simplification of the assembly of the watch.

As can be seen from the foregoing, according to the present invention, to reduce the thickness of the case 3, the movement 2 is assembled from above the case 3 and the movement 2 and the dial 6 are supported by the movement supporting members 9*a* and 9*a'* and the case 3, respectively.

Note, the hour hand and the minute hand are depicted on the respective circular films 8 and 7 by, for example, printing.

Figure 6:
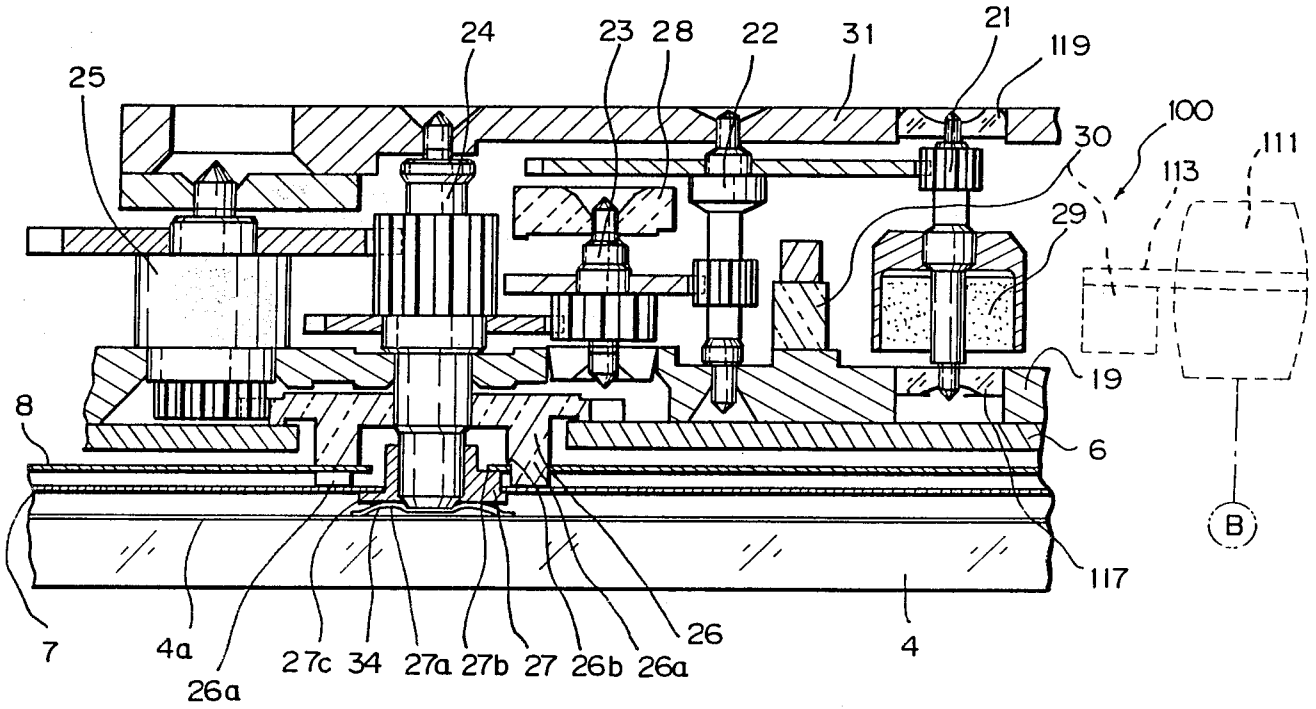
FIG. 6 is a sectional view of a main part of a movement of the watch shown in FIG. 1.

The movement 2 is now described in detail, with reference to FIG. 6.

In FIG. 6, a double-pole step motor 100 is formed by a coil 111 wound around a core 113 and electrically connected to a power source, such as a battery B, a yoke (stator) 30 connected to the core 113, a rotor 21, and a magnet 29 connected to the rotor 21. The rotor 21 is rotatably supported by the main plate 19 and a train wheel bridge 31 by bearings 117 and 119, respectively. The rotor 21 is connected to a second wheel 22 which is also rotatably supported by the main plate 19 and the train wheel bridge 31, so that the rotation of the rotor 21 is transmitted to the second wheel 22. The second wheel 22 is in mesh with a third wheel 23 which is rotatably supported by the main plate 19 and an intermediate bridge 28. The rotation of the rotor 21 is reduced by the second wheel 22 and transmitted to the third wheel 23. The third wheel 23 is in mesh with a center minute pinion 24 which is rotatably supported by the train wheel bridge 31 and the main plate 19, so that the minute pinion 24 can be rotated by the third wheel 23.

The minute pinion 24 has a seat 27 for the minute hand film 7 which will be referred to as a minute hand film seat hereinafter and which is integrally fitted thereto at the upper end thereof (lower end in FIG. 6) adjacent to the glass 4. The minute hand film seat 27 has a non-circular profile portion 27*a* on which the minute hand film 7 is attached so as to rotate with the minute pinion 24. Thus, the minute hand film 7 is rotated by the double pole step motor 100 (drive source).

The minute pinion 24 is in mesh with a minute wheel 25 which is in turn engaged with an hour wheel 26 having a plurality of projections 26*a* which are engaged by the circular film 8 carrying the hour hand 8*a*, so that the hour hand film 8 can be rotated by the minute pinion 24. The rotation of the hour hand film 8 is reduced to one sixtieth of that of the minute hand film 7 by the minute wheel 25.

The circular films 7 and 8 are mounted to the minute hand film seat 27 and the hour wheel 26 respectively, as follows.

Figure 7:
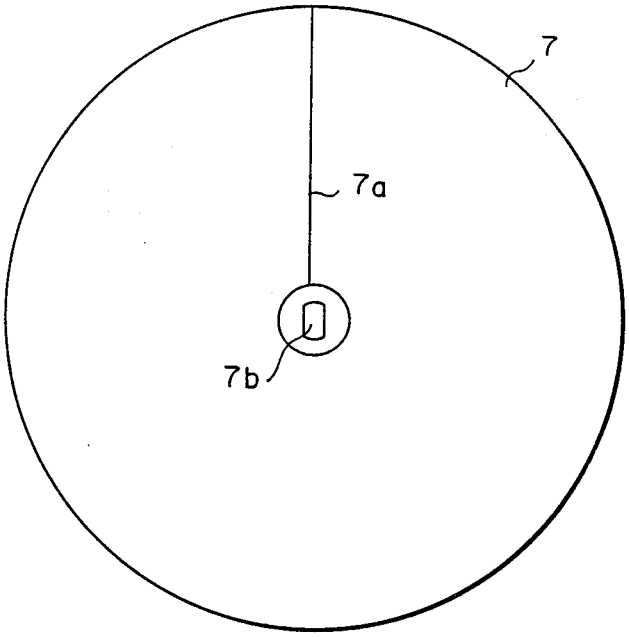
FIG. 7 is an enlarged plan view of a circular film carrying a minute hand (hereinafter, minute hand film)
Figure 8:
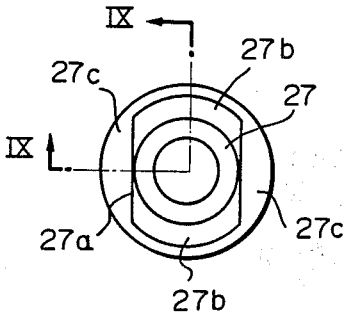
FIG. 8 is a plan view of a minute hand film seat.
Figure 9:
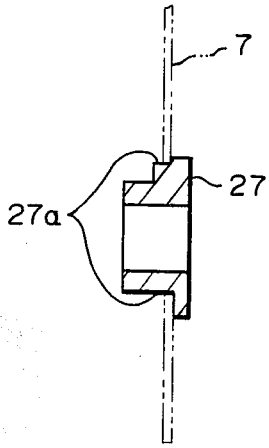
FIG. 9 is a sectional view taken along the line IX—IX in FIG. 8.

The circular film 7, which is made of a transparent thin film (having a thickness of about 0.05 mm) of polyester resin and which has the minute hand 7*a* depicted thereon by printing or evaporization, or the like, has a center hole 7*b* which is non-circular in shape. The non-circular hole 7*b* is formed by, for example, opposite straight right and left sides and opposite arcwise upper and lower sides, as shown in FIG. 7. The shape of the non-circular portion 27*a* of the minute hand film seat 27 corresponds to the shape of the non-circular hole 7*b* of the minute hand film 7, so that the non-circular portion 27*a* of the minute hand film seat 27 can be non-rotatably fitted in the corresponding center hole 7*b* of the minute hand film 7, as can be seen in FIGS. 8 and 9.

The minute hand film seat 27 is, for example, press fitted on the minute pinion 24.

Figure 10:
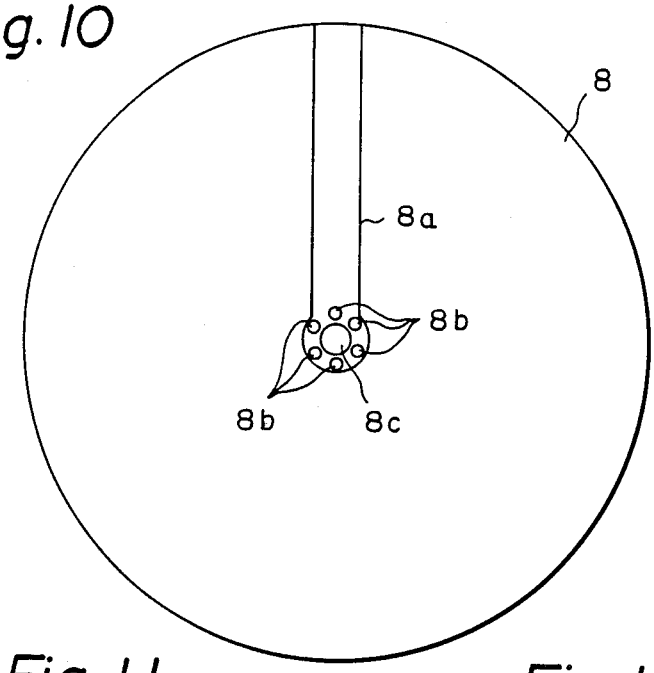
FIG. 10 is an enlarged view of a circular film carrying an hour hand (hereinafter, hour hand film)
Figure 11:
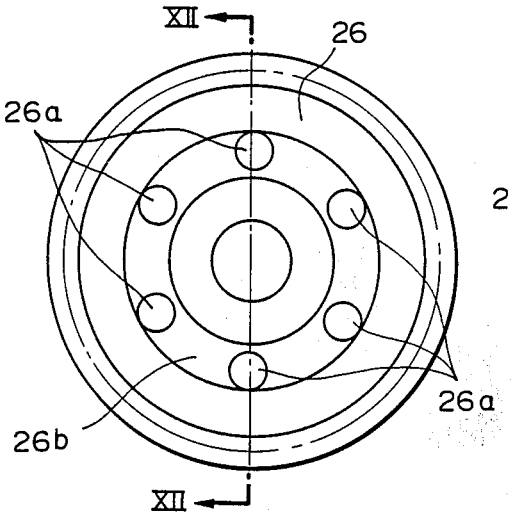
FIG. 11 is a plan view of an hour wheel.
Figure 12:
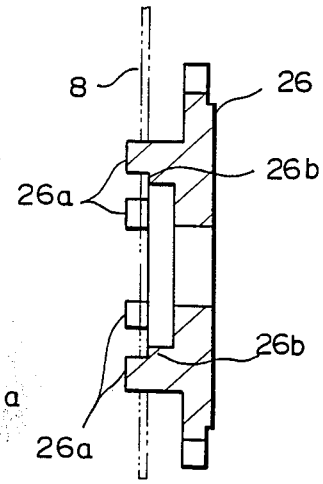
FIG. 12 is a sectional view taken along the line XII—XII in FIG. 11.

The hour hand film 8, which is also made of, for example, a transparent thin film (having a thickness of about 0.05 mm) of polyester resin and which has the hour hand 8*a* depicted thereon by printing or evaporization, etc., has a center hole 8*c* through which the minute hand film seat 27 attached to the minute pinion 24 extends and a plurality of, for example, six, circular holes 8*b* concentrically surrounding the center hole 8*c*, as shown in FIGS. 10, 11 and 12.

The hour hand 8*a* can be of any shape. For example, the hour hand 8*a* can be depicted as a figure, character, or any other shape for the purpose of decoration. The six projections 26*a* of the hour wheel 26 are engaged in the corresponding srx holes 8*b* of the hour hand film 8, so that the hour hand film 8 can be easily attached to the hour wheel 26 without allowing a relative rotation therebetween, by, for example, a pincette.

It should be appreciated that the minute hand film 7 with the hole 7*b* and the hour hand film 8 with the holes 8*b* and 8*c* can be easily manufactured, merely by pressing or punching, since a secondary machining process, which is necessary to provide, for example, mountings on the conventional needle type of minute and hour hands, becomes unnecessary in the present invention.

The circular films 7 and 8 are prevented from accidental disengagement from the minute hand film seat 27 and the hour wheel 26, respectively, as shown in FIG. 6. Namely, in FIG. 6, the hour hand film 8 is held between a shoulder portion 27*b* (FIG. 8) provided on the minute hand film seat 27 and a shoulder portion 26*b* (FIGS. 11, 12) provided on the hour wheel 26, so that the hour hand film 8 can not be accidentally disengaged from the hour wheel 26. On the other hand, the minute hand film 7 is held between a flange portion 27*c* of the minute hand film seat 27 and the projections 26*a* of the hour wheel 26, so that the minute hand film 7 can not be accidentally disengaged from the minute hand film seat 27. Note, a predetermined gap is provided between the circular films 7 and 8 which is defined by the top faces of the projections 26*a* and the flange portion 27*c* of the minute hand film seat 27.

The circular films 7 and 8 have a thickness of about 0.05 mm, which is very thin, as mentioned above, and accordingly, during rotation of the circular films 7 and 8, the circular films 7 and 8 may come into contact with each other or with the glass 4 or the dial 6 due to the dead weight or deflection of the films 7 and 8 at the portions thereof in the vicinity of the outer peripheries of the films 7 and 8.

Usually, the circular films 7 and 8 are made of an elongated or sheet like blank material on which the minute hand 7*a* and the hour hand 8*a* are preprinted, and which are successively pressed or punched. The circular films 7 and 8 have a very small thickness of about 0.05 mm, as mentioned before, and are preferably made of a plastic which is softer than a metal, although they can be also made of a metal or any other material. Taking the material of the circular films and the very small thickness thereof into consideration, it is extremely possible that burrs will be produced on the peripheries of the profiles of the circular films 7 and 8 punched by pressing dies or a punch. The burrs on the outer peripheries of the circular films 7 and 8 are more undesirable than those on the inner peripheries of the holes 7*b*, 8*b*, 8*c* at the centers or in the vicinity of the centers of the circular films 7 and 8, since the rotational torque (load) proportionally becomes larger in accordance with the increase of the radius of the rotational movement from a rotation center to a point at which the frictional load appears, supposing that the frictional load is always the same.

If such burrs, designated as g in FIG. 3, particularly those on the outer peripheries of the circular films 7 and 8, come into contact with each other between the circular films 7 and 8, a large resistance to the rotational movement of the circular films 7 and 8 occurs, in view of a large friction coefficient of the burrs g. Namely, a friction resistance due to contact between the burrs of the circular films 7 and 8 is substantially larger than that due to contact between the circular films 7 and 8 and the dial 6 or the glass 4. The large friction resistance due to the contact of the burrs eventually exceeds the driving torque of the rotational movement of the circular films 7 and 8 by the step motor 100, resulting in an undesirable stoppage of the watch.

To avoid this contact between the burrs g, preferably the circular films 7 and 8 have different diameters. In the illustrated embodiment, the diameter of the minute hand film 7 is smaller by $2\alpha$ than the diameter of the hour hand film 8. The difference $\alpha$ is, for example, about 0.1 mm ($\alpha \approx 0.1$ mm). The presence of the difference $\alpha$ in radius between the circular films 7 and 8 excludes the possibility of the contact of the burrs between the circular films 7 and 8, resulting in a prevention of a stall of the watch which otherwise would occur due to the contact of the burrs as mentioned above.

It has been experimentally confirmed that a friction load of about 0.2 g-cm was produced by the contact of the burrs g in the case where both the circular films 7 and 8 made of polyester had a diameter of about 20 mm and a thickness of about 0.05 mm, and a relative deflection of the circular films 7 and 8 of about 0.3 mm, and that the friction load was decreased to about 0.05 g-cm in the present invention in which the minute hand film 7 had a diameter of about 19.8 mm but the other conditions were the same as those of the prior art mentioned above.

Usually the drive torque of the minute pinion 24 is about 0.2 g-cm in the present invention, and accordingly, the watch will continue to work stably even if the burrs are produced on the circular films 7 and 8.

Figure 13:
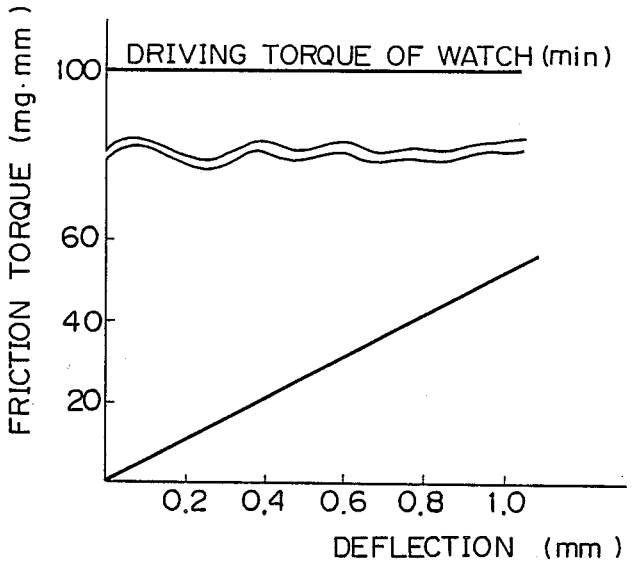
FIG. 13 is a diagram showing a relationship between deflection and contact load of the minute hand film.

FIG. 13 shows a diagram of a relationship between the friction load and the deflection (bend) of the circular film 7. The friction load is imposed by contact between the circular film 7 and the film 8, or with the glass 4, due to a deflection or bending of the circular film 7.

Generally speaking, the drive torque of the minute pinion 24 of a watch having two hands (minute hand and hour hand) is 100~150 mg.cm, and accordingly, the operation of the watch will not be stopped by a deflection of about 1 mm in the circular film 7. The same is true for the circular film 8. In addition, in the case of the circular film 8, the drive torque of the hour wheel 26 is usually ten or more times greater than the drive torque of the minute pinion 24, and thus the effect of the deflection or bending of the circular film 8 is less than that of the circular film 7.

The diagram shown in FIG. 13 is characteristic of the case in which the circular film 7 is secured to the minute hand film seat 27 by an adhesive, in a cantilever fashion. However, in practice, as shown in FIG. 6 and as described above, since the minute hand film 7 is freely supported by the minute hand film seat 27 at the center portion thereof, and in view of the strength of the materials used for the film 7, the effect of the deflection or bending of the minute hand film 7 can be further decreased. The same is true for the hour hand film 8.

In the illustrated embodiment, the gap between the glass 4 and the dial 6 is about 0.4 mm, which is small in comparison with the needle type minute and hour hands in the prior art, in which a gap of 1.5~1.6 mm must be provided between the glass 4 and the dial 6. Namely, because the circular films 7 and 8 are used instead of the conventional needle type hour and minute hands, the thickness of the watch can be reduced by more than 1 mm.

In a watch having circular films 7 and 8 with hour and minute hands depicted thereon, a problem occurs in that the circular films 7 and 8 can be attracted to each other or attracted by the glass 4 or the dial 6, due to static electricity produced in the glass 4 and the dial 6 and in the circular films 7 and 8, as mentioned before. The electrostatic attraction of the circular films 7 and 8 increases the load on the motor 100 which drives the circular films 7 and 8, resulting in an increase of the power consumption, or in a retardation of the rotation of the circular films 7 and 8.

To solve the electrostatic attraction problem mentioned above, according to the present invention, an electrostatic shielding means is provided.

Figure 14:
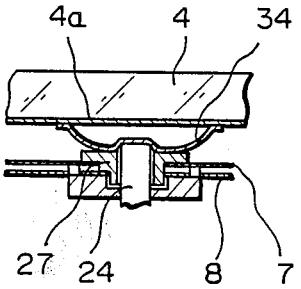
FIG. 14 is an enlarged sectional view of one embodiment of an electrostatic shielding device according to the present invention.

FIG. 14 shows a first embodiment of the electrostatic shielding means according to the present invention.

In FIG. 14, which is an enlarged sectional view of a part A in FIG. 3, the inner surface of the glass 4 adjacent to the circular films 7 and 8 is provided with a transparent electrical conductive layer 4*a* coated thereon, which is made of, for example, indium oxide or the like, and the conductive layer 4*a* is electrically connected to the minute pinion 24 which is made of an electrical conductive material, such as metal, by an electrical connecting member such as a belleville spring (initially coned disc spring) 34. The belleville spring 34 is electrically connected through the minute pinion 24 to the movement 2 which is electrically connected to the electrical conductive back cover 5.

Namely, the minute pinion 24 is electrically connected to the main plate 19, which is made of metal and which is, in turn, electrically connected to the ground spring 9. The static electricity in the glass can be thus grounded by the body of the wearer of the watch, through the back cover 5.

The belleville spring 34 has a center recess in which the top end of the minute pinion 24 in FIG. 14 is fitted. It is not necessary to secure the belleville spring 34 to the glass 4 and the minute pinion 24 by an adhesive or the like, because the belleville spring 34 can be firmly held between the glass 4 and the minute pinion 24 by its own elasticity.

The center recess of the belleville spring 34 can be replaced with a center hole in which the top end of the minute pinion 24 can be fitted.

Alternatively, it is also possible to electrically connect the conductive layer 4*a* to the minute hand film seat 27 instead of or in addition to the minute pinion 24, by the belleville spring 34.

Figure 15:
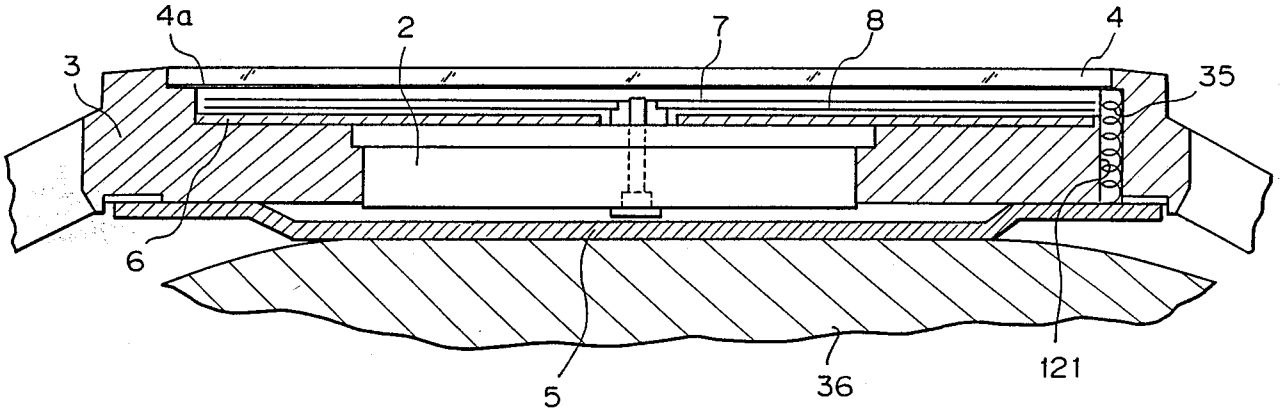
FIG. 15 is an enlarged sectional view of a second embodiment of an electrostatic shielding device according to the present invention.

FIG. 15 shows a second embodiment of the electrostatic shielding device. In FIG. 15, the inner surface of the glass 4 is coated with a transparent electrical conductive layer 4*a*, as in the embodiment shown in FIG. 14. However, in the second embodiment shown in FIG. 15, the conductive layer 4*a* is electrically connected to the back cover 5 through an electrically conductive coil spring 35 provided in a through hole 121 formed in the case 3 in the vicinity of the outer periphery of the glass 4 and outside the periphery of the circular films 7 and 8.

Namely, the coil spring 35 comes into electrical contact with the conductive layer 4*a* at one end and with the back cover 5 at the opposite end. In this second embodiment, the static electricity produced in the glass 4 flows to the wrist 36 of the wearer of the watch through the conductive layer 4*a*, the coil spring 35, and the back cover 5.

Figure 16:
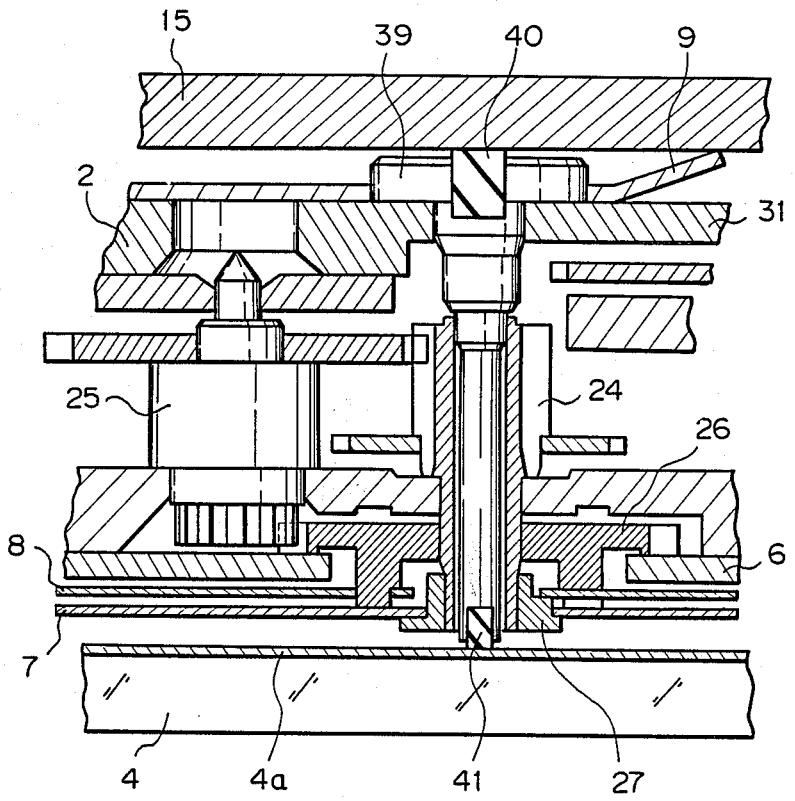
FIG. 16 is a partial sectional view of a third embodiment of an electrostatic shielding device according to the present invention.

FIG. 16 shows a third embodiment of an electrostatic shielding device according to the present invention. In FIG. 16, the inner surface of the glass 4 is also coated with a transparent electrical conductive layer 4*a*, and the train wheel bridge 31 has a supporting shaft 39 secured thereto on which the minute pinion 24 is rotatably supported. The supporting shaft 39 has a first electrically conductive rubber body 40 secured thereto, which is in contact with the back cover 5. The supporting shaft 39 is made of an electrically conductive material, such as metal. The supporting shaft 39 has, at the opposite end thereof, a second electrically conductive rubber body 41 secured thereto which is in contact with the conductive layer 4*a* of the glass 4. The static electricity produced in the glass 4 flows to the back cover 5 through the conductive layer 4*a*, the second conductive rubber body 41, the supporting shaft 39, and the first conductive rubber body 40. Note that the first conductive rubber body 40 can be omitted, since the supporting shaft 39 is electrically connected to the minute pinion 24, which is electrically connected to the back cover 5 through the ground spring 9, as mentioned in the first embodiment shown in FIG. 14. The third embodiment shown in FIG. 16 can be advantageously applied in particular to a watch having an existing supporting shaft 39 for the minute pinion 24.

Figure 17:
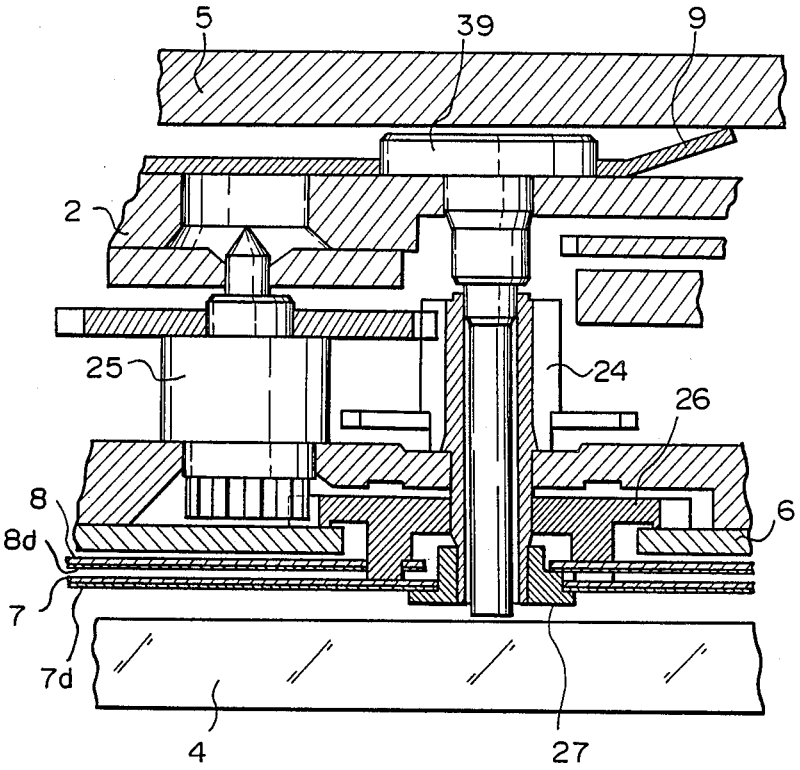
FIG. 17 is a partial sectional view of a fourth embodiment of an electrostatic shielding device according to present invention.

FIG. 17 shows a fourth embodiment of an electrostatic shielding device according to the present invention.

In the fourth embodiment shown in FIG. 17, the circular films 7 and 8 are coated with transparent electrically conductive layers 7*d* and 8*d* on one of or both of the surfaces of the films 7 and 8, for example, on the outer surfaces thereof adjacent to the glass 4, so that even when the static electricity produced in the glass is transmitted to the circular films 7 and 8 by, for example, contact therebetween, the static electricity in the circular films 7 and 8 flows to the movement 2 and to the back cover 5 through the ground spring 9, as mentioned before. The circular films 7 and 8, and accordingly, the conductive layers 7*d* and 8*d*, are connected to the minute hand film seat 27, which is made of an electrically conductive material such as metal, and the hour wheel 26, which is made of an electrically conductive material such as metal, respectively. The minute hand film seat 27 and the hour wheel 26 are electrically connected to the minute pinion 24.

Figure 18:
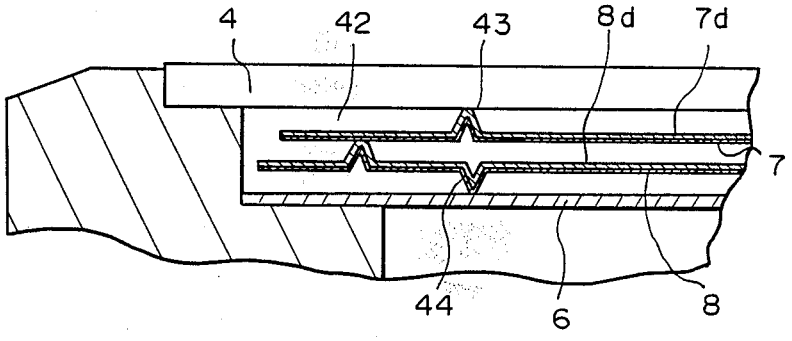
FIG. 18 is a partial sectional view of a fifth embodiment of an electrostatic shielding device according to the present invention.

FIG. 18 shows a modification of the embodiment of FIG. 17. In the modification shown in FIG. 18, the circular films 7 and 8 having the transparent electrically conductive layers 7*d* and 8*d* coated thereon, are provided with a plurality of projections 42, 43, and 44. In the illustrated embodiment, the circular film 7 is provided with projections 43 which project from the surface thereof adjacent to the glass 4, and the circular film 8 is provided with projections 42 on the surface thereof adjacent to the circular film 7, and projections 44 on the opposite surface thereof. The projections 42 can be provided on the surface of the circular film 7 adjacent to the circular film 8 in place of or in addition to the projections 42 on the surface of the circular film 8 adjacent to the circular film 7. The projections 42 provide a predetermined separation between the circular films 7 and 8 to prevent a close surface contact therebetween caused by an electrostatic attraction. Preferably, two or three projections 42 are provided on a same circle at a substantially equiangular distance between the circular films 7 and 8. An increase of the number of the projections 42 increases the resistance to the rotational movement of the circular films 7 and 8, and accordingly, it is neither advisable nor necessary to provide a large number of projections 42 between the circular films 7 and 8.

The projections 42 prevent the circular film 7 from coming into close surface contact with the glass 4, and the projections 44 prevent the circular film 8 from coming into close surface contact with the dial 6.

The concept of the arrangement and number of the projections 42 mentioned above is also applicable to the projections 43 and 44.

The projections 43 and/or 44 can be omitted, since the surface contact between the films 7 and 8 is most significant problem to be solved.

The embodiment shown in FIG. 18 is particularly useful when the electrical connection between the electrically conductive layers 7*d* and 8*d* and the back cover 5 through the movement 2, as mentioned above, is accidentally interrupted or broken. Namely, in the modification shown in FIG. 18, the circular films 7 and 8 can be prevented from coming into close surface contact with each other or with the glass 4 or the dial 6, even if the circular films 7 and 8 are charged with static electricity.

Figure 19:
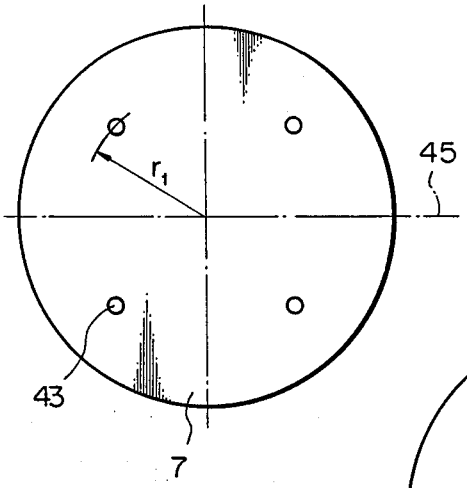
FIG. 19 is a plan view of a minute hand film shown in FIG. 18.
Figure 20:
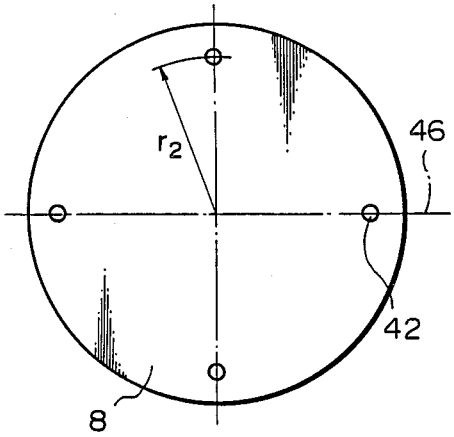
FIG. 20 is a plan view of an hour hand film shown in FIG. 18.

Preferably, as can be seen from FIGS. 19 and 20, the radius $r_1$ of an imaginary circle on which the projections 43 are arranged on the circular film 7 is different from the radius $r_2$ of an imaginary circle on which the projections 42 of the circular film 8 are arranged, so that there is no interference between the projections 42 and 43. Note, in the illustrated embodiment, $r_1 < r_2$. Furthermore, preferably, the phase of arrangement of the projections 42 differs from the phase of arrangement of the projections 43 by, for example, 45°, so that the four projections 42 and the four projections 43 are uniformly arranged at an equiangular distance of 45° when viewed from above. This arrangement contributes to a uniform distribution of the resistance to the rotational movement of the films 7 and 8 due to the projections 42 and 43. The projections 44 can be located in the same arrangements as the projections 43. The projections 42, 43 and 44 can be formed by, for example, coining or down driving machining, or by other machining.

Figure 21:
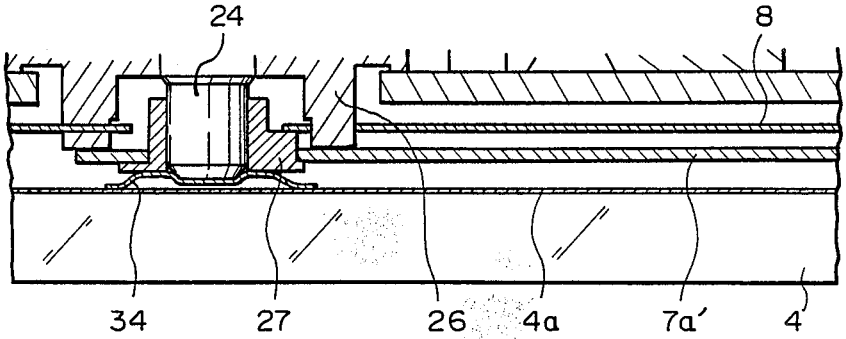
FIG. 21 is a view showing a modification of FIG. 6, in which only an hour hand is in the form of a circular film.

FIG. 21 shows another modified embodiment of the present invention, in which the circular film 7 for the minute hand 7*a* is replaced with a conventional needle type minute hand 7*a*'. The electrostatic shielding device of the first embodiment shown in FIGS. 6 and 14 is provided in the modification in FIG. 21. As can be seen from FIG. 21, the present invention can be also applied to a watch in which only one of the hour and minute hands hour is in the form of a circular film and the other hand is a conventional needle type. In the embodiment shown in FIG. 21, it is also possible to provide a needle type hour hand and a circular film for a minute hand.

As can be understood from the above discussion, according to the present invention, since the minute and hour hands are in the form of circular films, the thickness of the hands can be reduced, resulting in a reduced thickness of the watch as a whole.

Furthermore, according to the present invention, since the static electricity produced in the glass can be grounded through the back cover of the watch, the circular films are prevented from coming into surface contact with each other or with the glass or the dial due to electrostatic attraction. This results in a decrease of the power consumption by the driving motor and in a decrease in the possibility of a retardation of the rotation of the hands.

The use of circular films for hours and minute hands makes it possible to expand the designs of the hour and minute hands, thus increasing the number of product variations on the market.

According to the present invention, the circular films for the hour hand and for the minute hand are not rigidly connected to the hour wheel and the minute hand film seat, but are freely supported thereon, respectively, and accordingly, possible deflection or bending of the circular films is effectively absorbed. On the other hand, since the circular films for the hour and minute hands are firmly held by the hour wheel and the minute hand film seat, the circular films can be driven to rotate by the driving motor without accidental displacement of the films.

Further, the elastic conductive connecting members, such as a belleville spring and the ground spring, effectively absorb possible dimensional errors in the various elements of the watch.

We claim:

1. A watch with hour and minute hands, at least one of which is in the shape of a rotatable circular film, comprising a case, a movement which includes a drive which rotates the hour and minute hands, a train wheel which transmits the rotation of the drive to the hour and minute hands, a minute pinion which is operatively connected to the train wheel to rotate the minute hand, an hour wheel which is operatively connected to the minute pinion to rotate the hour hand, and a glass which is attached to the case to cover the movement on one side of the case, and a back cover which is attached to the case to cover the movement on the opposite side of the case and which is made of an electrically conductive material, wherein the improvement comprises an electrostatic shielding means for conducting static electricity which can be produced in the glass to the back cover of the watch case.

2. A watch according to claim 1, wherein said electrostatic shielding means comprises a transparent electrically conductive layer provided on an inner surface of the glass adjacent to the movement, and an electrostatic shielding member which establishes an electrical connection between the electrically conductive layer of the glass and the electrically conductive back cover.

3. A watch according to claim 2, wherein said electrically conductive layer is an indium oxide layer coated on the inner surface of the glass.

4. A watch according to claim 2, wherein said electrostatic shielding member is a ground spring which is held between the movement and the back cover to support the movement.

5. A watch according to claim 4, wherein said movement comprises a main plate which supports the train wheel and which is made of an electrically conductive material, and wherein said ground spring is brought into electrical contact with the main plate and the back cover.

6. A watch according to claim 2, wherein said electrostatic shielding means comprises an electrical connecting member which electrically connects the electrically conductive layer on the glass to the back cover.

7. A watch according to claim 6, wherein said electrical connecting member is a belleville spring which is provided between the electrically conductive layer on the glass and the minute pinion, which is made of an electrically conductive material, to provide an electrical connection therebetween.

8. A watch according to claim 6, wherein said electrical connecting member is a coil spring which is provided in the case between the glass and the back cover to provide an electrical connection therebetween.

9. A watch according to claim 5, wherein said electrostatic shielding means comprises an electrical connecting member which electrically connects the electrically conductive layer on the glass to the back cover through the ground spring.

10. A watch according to claim 9, wherein said movement comprises an electrically conductive supporting shaft which rotatably supports the minute pinion and wherein said electric connecting member is provided with electrically conductive rubber bodies between the electrically conductive layer of the glass and one end of the supporting shaft and between the back cover and the other end of the supporting shaft, respectively.

11. A watch according to claim 1, wherein the minute hand is in the form of the circular film.

12. A watch according to claim 11, wherein said movement comprises a minute hand film seat which is connected to the minute pinion so as to rotate together with the minute pinion, said minute hand in the form of a circular film being supported on the minute hand film seat so as to rotate together with the minute hand film seat 13. A watch according to claim 12, further comprising means for preventing a relative rotation of the minute hand in the form of a circular film to the minute hand film seat.

14. A watch according to claim 13, wherein said means for preventing the relative rotation between the minute hand in the form of a circular film and the minute hand film seat comprises a combination of a non-circular hole and a correspondingly shaped shaft which is fitted in the non-circular hole.

15. A watch according to claim 14, wherein displacement of the minute hand in the form of a circular film is restricted in the axial direction of the minute pinion by the minute hand film seat and the hour wheel.

16. A watch according to claim 15, wherein said hour hand is in the shape of a circular film.

17. A watch according to claim 16, wherein said hour hand in the form of a circular film is supported on the hour wheel so as to rotate together with the hour wheel.

18. A watch according to claim 17, wherein displacement of the hour hand in the form of a circular film is restricted along the axial direction of the minute pinion by the hour wheel and the minute hand film seat.

19. A watch according to claim 1, wherein both the minute hand and the hour hand are in the form of circular films having different diameters.

20. A watch according to claim 1, wherein said circular film has a transparent electrically conductive layer coated thereon, so that the transparent electrically conductive layer of the circular film can be electrically connected to the back cover of the watch case.

21. A watch according to claim 19, wherein at least one of the circular films is provided with projections between the circular films to ensure a predetermined separation space therebetween.

22. A watch according to claim 4, wherein said movement comprises a coil terminal sheet with a predetermined conductive pattern, and wherein said watch further comprises a switch lever which comes into contact with said predetermined conductive pattern at one end thereof, and a push button which is movably supported in the case to bear against the other end of the switch lever, so that when the push button is pushed, the other end of the switch lever comes into contact with the ground spring, which is located below the switch lever.

* * * * *